US007666265B2

(12) United States Patent
Yoon et al.

(10) Patent No.: US 7,666,265 B2
(45) Date of Patent: Feb. 23, 2010

(54) DISH WASHER

(75) Inventors: Sangheon Yoon, Gwangmyeong-si (KR); Nungseo Park, Seoul (KR); Dae Yeong Han, Seoul (KR); Byung Hwan Ahn, Gimhae-Si (KR)

(73) Assignee: LG Electronics Inc., Seoul (KR)

( * ) Notice: Subject to any disclaimer, the term of this patent is extended or adjusted under 35 U.S.C. 154(b) by 392 days.

(21) Appl. No.: 10/558,094

(22) PCT Filed: Sep. 14, 2005

(86) PCT No.: PCT/KR2005/003035

§ 371 (c)(1),
(2), (4) Date: Jan. 22, 2007

(87) PCT Pub. No.: WO2006/031060

PCT Pub. Date: Mar. 23, 2006

(65) Prior Publication Data

US 2007/0102028 A1 May 10, 2007

(30) Foreign Application Priority Data

Sep. 14, 2004 (KR) ..... 10-2004-73396
Sep. 14, 2004 (KR) ..... 10-2004-73397

(51) Int. Cl.
*B08B 3/00* (2006.01)

(52) U.S. Cl. ..... 134/56 D; 134/47; 134/57 D; 134/58 D; 134/90; 134/105; 134/106; 134/115 G; 134/184

(58) Field of Classification Search ..... 134/56 D, 134/105, 184, 198, 47, 57 D, 58 D, 90, 106, 134/115 G, 163
See application file for complete search history.

(56) References Cited

U.S. PATENT DOCUMENTS

| | | | | |
|---|---|---|---|---|
| 3,322,479 | A | 5/1967 | Payton et al. | |
| 3,519,796 | A | 7/1970 | Bebinger | |
| 5,299,586 | A * | 4/1994 | Jordan et al. | 134/111 |
| 5,377,707 | A * | 1/1995 | Young, Jr. | 134/104.1 |
| 5,429,679 | A | 7/1995 | Young, Jr. | |
| 5,900,070 | A * | 5/1999 | Jarvis et al. | 134/18 |
| 6,418,943 | B1 | 7/2002 | Miller | |

FOREIGN PATENT DOCUMENTS

| | | |
|---|---|---|
| DE | 19736794 C2 | 4/2000 |
| EP | 0 925 754 A2 | 6/1999 |
| FR | 2 596 429 A3 | 10/1987 |
| JP | 11-285465 | 10/1999 |
| JP | 2004-097608 | 4/2004 |
| KR | 1996-0009578 | 10/1996 |
| KR | 1998-0006631 | 4/1998 |

OTHER PUBLICATIONS

International Search Report dated Dec. 19, 2005.

* cited by examiner

*Primary Examiner*—Joseph L Perrin
*Assistant Examiner*—Benjamin Osterhout
(74) *Attorney, Agent, or Firm*—McKenna Long & Aldridge LLP

(57) ABSTRACT

Sump assembly in a dishwasher holds washing water and supplies the washing water to spray nozzles. The sump assembly includes a sump housing for holding washing water, a heater assembly fastened to an inside of the sump housing for heating the washing water, and a pump fastened to the sump housing for pumping washing water heated by the heater assembly.

12 Claims, 5 Drawing Sheets

DISH WASHER

This application claims priority to International Application No. PCT/KR2005/003035 filed on Sep. 14, 2005, as well as Korean Applications P 2004-73397 filed on Sep. 14, 2004 and P 2004-73396 filed on Sep. 14, 2004, all of which are incorporated by reference, as if fully set forth herein.

TECHNICAL FIELD

The present invention relates to dishwashers, and more particularly, to a sump assembly in a dishwasher for holding washing water and supplying the washing water to spray nozzles.

BACKGROUND ART

The dishwasher is a home appliance for washing dishes by spraying high pressure washing water to the dishes by using spray nozzles. A related art dishwasher is provided with a tub having a washing space therein, a plurality of dish racks in the tub, spray nozzles for spraying washing water to the dish racks, and a sump assembly for holding the washing water and supplying the washing water to the spray nozzles.

Upon putting the dishwasher into operation, clean external washing water is held in the sump assembly, and the sump assembly supplies the washing water to the spray nozzles. Then, the spray nozzles spray high pressure washing water to the dishes on the dish racks in the tub, for washing the dishes.

As described before, the related art dishwasher cleans the dishes by spraying the high pressure washing water to the dishes. However, this is not adequate for removal of sticky food from the dishes, perfectly.

DISCLOSURE

Technical Problem

An object of the present invention is to provide a sump assembly in a dishwasher, which can wash dishes with hot water for perfect removal of sticky food from the dishes.

Another object of the present invention is to provide a sump assembly in a dishwasher, which can supply washing water heated by a heater to spray arms without a heat loss.

Another object of the present invention is to provide a sump assembly in a dishwasher, which has a structure which enables easy mounting/dismounting of a heater on/off the sump housing for heating washing water.

Another object of the present invention is to provide a sump assembly in a dishwasher, which has a structure which enables an effective prevention of leakage of water from between a connection portion of the heater and the sump housing.

Technical Solution

The objects of the present invention can be achieved by providing a dishwasher including a sump housing for holding washing water, a heater assembly fastened to an inside of the sump housing for heating the washing water, and a pump fastened to the sump housing for pumping washing water heated by the heater assembly.

The heater assembly is detachable from the sump housing from an outside of the sump housing.

The heater assembly may be provided to a bottom of the sump housing. The sump housing includes a recess in a bottom for holding the washing water, and the heater assembly may be provided to the recess.

The pump includes an impeller in the sump housing above the heater assembly for pumping heated washing water. The pump may further include a motor under the sump housing, and a shaft passed through a bottom of the sump housing for transmission of driving force from the motor to the impeller. The heater assembly does not interfere with the shaft when the heater assembly is separated from the sump housing.

The sump assembly further includes a disposer rotatably mounted in the sump housing between the impeller and the bottom of the sump housing for smashing soil contained in the washing water. The impeller and the disposer may be driven by the same motor. The heater assembly may surround the disposer. The heater assembly does not interfere with the disposer when the heater assembly is separated from the sump housing.

The sump housing may include an opening in a side for pass through of the heat assembly. The heater assembly does not interfere with components in the sump housing when the heater assembly is placed in/taken out of the sump housing through the opening.

The heater assembly may include a heater passed through the opening for heating the washing water, and a packing in the opening for sealing the opening, and the heater is passed therethrough.

The heater assembly may further include a clamp fastened to the sump housing for holding the heater. The heater slides into the clamp or away from the clamp when the heater assembly is inserted into the sump housing or drawn out of the sump housing through the opening.

The heater assembly may further includes a pressing mechanism for sealing the opening perfectly by pressing down, to deform the packing. The pressing mechanism expands a side of the packing for preventing the packing from escaping from the opening. The pressing mechanism can be fastened, or released from an outside of the sump housing.

In the meantime, in another aspect of the present invention, a dishwasher includes a tub for placing dishes therein, a sump housing for holding washing water, a heater assembly fastened to an inside of the sump housing for heating the washing water, a pump fastened to the sump housing for pumping washing water heated by the heater assembly, and at least one spray nozzle.

ADVANTAGEOUS EFFECTS

The spray of the hot washing water to the dishes permits to remove sticky food from the dishes completely.

The heater assembly mounted to the sump housing by means of special holding mechanism and the pressing mechanism permits easy mounting/dismounting of the heater assembly to/from the sump assembly from an outside of the sump assembly, and perfect prevention of water leakage from a connection portion between the sump housing and the heater assembly.

DESCRIPTION OF DRAWINGS

The accompanying drawings, which are included to provide a further understanding of the invention, illustrate embodiment(s) of the invention and together with the description serve to explain the principle of the invention. In the drawings.

BEST MODE

Reference will now be made in detail to the preferred embodiments of the present invention, examples of which are illustrated in the accompanying drawings. Wherever possible, the same names and reference numbers will be used throughout the drawings to refer to the same or like parts, and repetitive description of which will be omitted.

Figure 1:
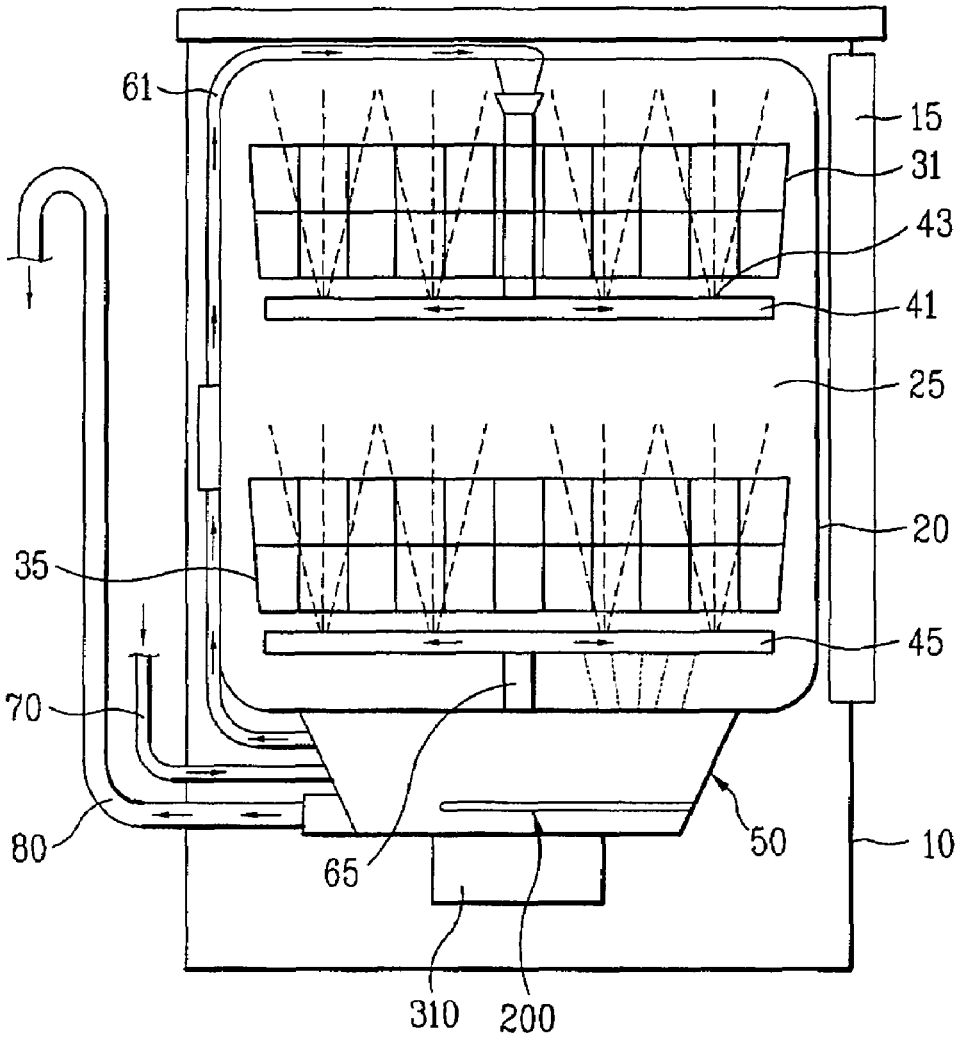
FIG. 1 illustrates a diagram of a dishwasher in accordance with a preferred embodiment of the present invention.

Referring to FIG. 1, in the case 10 which forms an exterior of the dishwasher, there is a tub 20 provided thereto. At one side of the case 10, there is a door 15 for opening/closing the tub 20. In the tub 20, there is a washing chamber 25 for holding dishes, in which at least one rack is provided. As shown in FIG. 1, for an example, the rack includes an upper rack 31 provided to an upper portion of the washing chamber 25, and a lower rack 35 provided to a lower portion of the washing chamber 25.

Moreover, in the washing chamber 25, there is at least one spray arm provided adjacent to the spray arm. For an example, as shown in FIG. 1, the spray arm includes an upper arm 41 under the upper rack 31, and a lower arm 45 under the lower rack 35. Both the upper arm 41 and the lower arm 45 are rotatable, and each has at least one spray nozzle 43 for spraying washing water.

Figure 2:
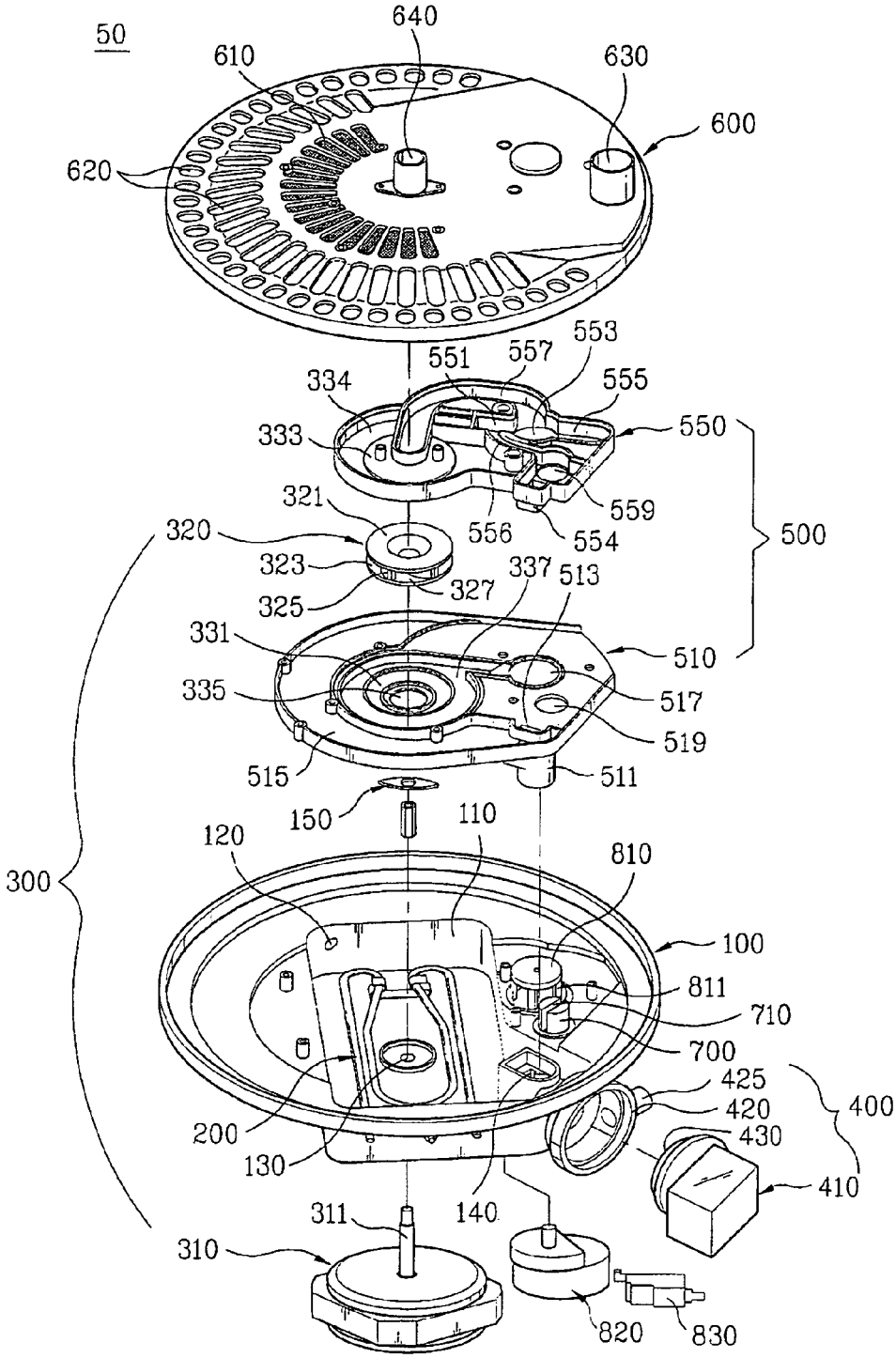
FIG. 2 illustrates an exploded perspective view of the sump assembly in accordance with a preferred embodiment of the present invention.

In the case 10, for an example, under the tub 20, there is a sump assembly 50 for supplying washing water to the upper arm 41 and the lower arm 45. The sump assembly 50 is connected to the upper arm 41 with a first connection pipe 61, and to the lower arm 45 with a second connection pipe 65. The sump assembly 50 is supplied with washing water from an outside of the dishwasher, holds the washing water therein, and supplies the washing water to the upper arm 41 and the lower arm 45 through the first connection pipe 61 and the second connection pipe 65, selectively or at the same time. FIG. 2 illustrates a structure of the sump assembly 50 in detail, referring to which the sump assembly will be described in more detail.

Referring to FIG. 2, the sump assembly 50 includes a sump housing 100 for holding washing water, a heater assembly 200 for heating the washing water, a drain pump 400 for discharging the washing water to an outside of the dishwasher, a water supply pump 300 for pumping up the washing water from the sump housing 100, a water guide assembly 500 for supplying pumped washing water to the upper arm 41 and the lower arm 45, and a cover 60 for covering the sump housing 100, and filtering the washing water.

At a bottom center of the sump housing 100, there is a recess 110 for holding the washing water, and at one side of the recess 110, there is a water supply hole 120 for connection of the water supply pipe 70 thereto. In the sump housing 100 adjacent to the recess 110, there is a drain chamber 140 provided thereto. The drain chamber 140 has a hole (not shown) in one side in communication with the recess 110, and an open top in communication with a soil chamber 515 in the water guide assembly 500.

The drain pump 400 is mounted to a side of the sump housing 100. The drain pump 400 is in communication with the drain chamber 140 for discharging washing water from the recess 110, the drain chamber 140, and the soil chamber 515 to an outside of the dishwasher. The drain pump 400 includes an impeller housing 420, a motor 410, and an impeller 430.

Referring to FIG. 2, the impeller housing 420 is mounted to a side of the sump housing 100, and in communication with the drain chamber 140. The impeller housing 420 may be formed as one body with the sump housing 100. The impeller housing 420 has a nipple 425 projected from a side for connecting a drain hose 80 thereto.

The motor 410 having a shaft for mounting the impeller 430 thereto is mounted to the impeller housing 420 such that the impeller 430 is placed in the impeller housing 420. According to this, upon putting the drain pump 400 into operation, the washing water held in the recess 110, the drain chamber 140, and the soil chamber 515 is discharged to an outside of the dishwasher through the drain chamber 140, the drain pump 400, and the drain hose 80.

The water supply pump 300 pumps the washing water from above the heat assembly 200 so that the washing water heated by the heater assembly 200 is supplied to the spray arms. A structure of the water supply pump 300, having the motor 310, the impeller 320, and the impeller housing, will be described in more detail.

Referring to FIG. 2, the motor 310 is mounted to an underside of the sump housing 100, and the motor 310 is mounted such that the shaft 311 of the motor 310 is passed through a hole 130 in a bottom of the recess 110. As shown in FIG. 2, there is a disposer 150 having a plurality of blades fixed to the shaft 311 passed through the bottom of the sump housing 100. The disposer rotates when the motor 310 is in operation, to smash soil contained in the washing water held in the recess 110.

The shaft 311 also has the impeller 320 fixed thereto. As shown in FIG. 2, the impeller 320 is mounted over the heater assembly 200 for pumping washing water heated by the heater assembly 200 as the impeller 320 rotates. The impeller 320 will be described in more detail.

The impeller 320 has a structure in which washing water is drawn in an axial direction, and discharges the washing water in a radial direction. For this, the impeller 320 includes an upper plate 321 and a lower plate 323 spaced from each other, and a plurality of curved blades 325 between the upper plate 321 and the lower plate 323.

The upper plate 321 has no opening, and the lower plate 323 has an inlet (not shown) at a center for receiving the washing water. The upper plate 321 has a hub (not shown) at a center for placing the shaft 311 at a lower end of the hub. Between adjacent blades 325 of the plurality of curved blades 325 between the upper plate 321 and the lower plate 323, there are outlets 327 for discharging the washing water introduced to the impeller 320 through the inlet.

The impeller housing surrounds the impeller 320, and guides washing water moved by the impeller 320. The impeller housing is formed as one body with the water guide assembly 500, rather than formed as an independent body. The water guide assembly 500 includes a lower piece 510 and an upper piece 550, a portion of an assembly of which forms the impeller housing. The impeller housing will be described in more detail.

Referring to FIG. 2, at an upper surface of the lower piece 510 of the water guide assembly 500, there are an inlet 335 for receiving water from the recess 110 in the sump housing 100, a recessed lower seat 331 for receiving a lower portion of the impeller 320, and a lower flow passage 337 for guiding the water pumped by the impeller 320. The recessed lower seat 331 surrounds the inlet 335 which is in communication with an inlet (not shown) to the impeller 320 in the recessed lower seat 331. The lower flow passage 337 surrounds the recessed lower seat 331.

At an underside surface of the upper piece 550 of the water guide assembly 500, there are a recessed upper seat 333 opposite to the recessed lower seat 331, for receiving an upper portion of the impeller 320, an upper flow passage 334 opposite to the lower flow passage 337 for guiding water pumped by the impeller 320, and an outlet 551 for guiding water from the upper flow passage 334 to an upper surface of the upper piece 550. The upper flow passage 334 surrounds the recessed upper seat 333, and the outlet 551 is at an end of the upper flow passage 334.

Upon putting the motor into operation, the impeller 320 rotates in a space defined with the recessed lower seat 331 and the recessed upper seat 333. Then, the washing water is introduced to the impeller 320 from the recess 110 in the sump housing 100 through the inlet 335, and the impeller discharges the washing water in a radial direction. The washing water from the impeller 320 moves along a flow passage defined by the lower flow passage 337 and the upper flow passage 334, and, finally, is guided to an upper surface of the upper piece 550 of the water guide assembly 500 through the outlet 551. A portion of the washing water introduced to the upper surface of the upper piece 550 is guided to the upper arm 41 and the lower arm 45 by the water guide assembly 500, selectively, or at the same time. The water guide assembly 500 will be described in detail.

As described before, the water guide assembly 500 includes the upper piece 550 and the lower piece 510. The upper piece 550 has a valve receiving portion 553 in communication with the outlet 551. The valve receiving portion 550 is connected to a first guide flow passage 557 for supplying the washing water to the lower arm 45, and a second guide flow passage 555 for guiding the washing water to the upper arm 41. The first guide flow passage 557 extends from the valve receiving portion 553 at the upper surface of the upper piece 550 to the center of the upper piece 550, and the second guide flow passage 555 extends from the valve receiving portion 553 at the upper surface of the upper piece 550 to an edge of the upper piece 550.

The valve receiving portion 553 is provided with a diverting valve 810 for guiding a portion of washing water from the outlet 551 to the first guide flow passage 557 or to the second guide flow passage 555, selectively, or at the same time. At a side of the diverting valve 810, there is a rib 881 for closing a plurality of flow passages which make the outlet 551 and the first guide flow passage 557 and the second guide flow passage 555 in communication, and the first guide flow passage 557 and the second guide flow passage 555, selectively.

Referring to FIG. 2, the diverting valve 810 is mounted on the sump housing 100 positioned at the valve receiving portion 553 when the water guide assembly 500 is mounted on the sump housing 100. For this, the lower piece 510 has a hole 517 in correspondence to the valve receiving portion 553, through which the diverting valve 810 is passed.

Under the sump housing 100, there is a driving mechanism for operating the diverting valve 810. As shown in FIG. 2, the driving mechanism includes a crank 820 connected to the diverting valve 810, a linkage 830 connected to the crank 820, and a power source connected to the linkage 810, such as a step motor (not shown). The linkage 830 reciprocates on a straight line by the step motor, and the crank 820 converts the linear reciprocation of the linkage 830 to rotating motion of the diverting valve 810.

According to this, when the dishwasher washes or rinses the dishes, the diverting valve 810 rotates in regular/reverse direction by the driving mechanism, such that the rib 811 blocks the first guide flow passage 557 or the second guide flow passage 555, selectively. According to this, the washing water pumped by the water supply pump 300 is supplied to the first guide flow passage 557 and/or the second guide flow passage 555 by the diverting valve 810, and, therefrom, to the lower arm 45, and/or the upper arm 41, selectively or at the same time.

In the meantime, rest of the washing water, pumped by the water supply pump 300, and guided to the upper surface of the upper piece 550 of the water guide assembly 500, is used in measuring a degree of contamination of the washing water, returned to the sump housing 100 after filtered, and held in the recess 110, which will be described in more detail.

At the upper surface of the upper piece 550, there is a bypass 556 in communication with the outlet 551. In the middle of the bypass 556, there is a sensor receiving portion 559. In the sensor receiving portion 559, there is a sensor assembly 700 provided thereto, for measuring a degree of contamination of the washing water pumped by the water supply pump 300 and introduced to the bypass 556.

Referring to FIG. 2, the sensor assembly 700 is mounted to the sump housing 100, positioned at the sensor receiving portion 559 when the water guide assembly 500 is mounted to the sump housing 100. For this, the lower piece 510 has a hole 519 in correspondence to the sensor receiving portion 559, having the sensor assembly 700 passed therethrough.

Referring to FIG. 2, at a center of the sensor assembly 700, there is a channel 710 in communication with the bypass 556. Accordingly, the washing water introduced to the bypass 556 passes through the channel 710. In the sensor assembly 700, there are a light emission portion (not shown), and a light receiving portion (not shown) arranged to face each other with the channel in between. Therefore, a light from the light emission portion passes through the washing water flowing through the channel 710, and reaches to the light receiving portion. According to this, the sensor assembly 700 measures the degree of contamination with reference to an intensity of the light the light receiving portion is received.

The degree of contamination of the washing water measured by the sensor assembly 700 is used as a base for determining a washing time period, a number of times of washing, a rinsing time period, a number of times of rinsing, and so on. For an example, if an intensity of the light reached to the light receiving portion is very weak, it implies that the washing water is contaminated very much, when the dishwasher changes the washing water, or increases the number of times of washing or rinsing by at least one time.

In the meantime, the washing water passed through the sensor assembly 700 reaches to a first drain 554 at an end of the bypass 556. The first drain 554 is connected to the second drain 513 provided to the lower piece 510, which extends from the lower piece 510 to the drain chamber 140 in the sump housing 100. Therefore, rest of the washing water, pumped by the water supply pump 300, and introduced to the upper surface of the upper piece 550, is introduced to the drain chamber 140 thorough the bypass 556, the sensor assembly 700, and the first, and second drains 554, and 513.

The washing water is not discharged from the drain chamber 140 to an outside of the dishwasher through the drain hose 80 when the drain pump 400 is not in operation. Since the drain chamber 140 has a check valve (not shown) for opening/closing the hole (not shown) in the drain chamber 140, which makes the drain chamber 140 and the recess 110 in communication, the washing water is not introduced to the recess 110 from the drain chamber 140, too.

Accordingly, the washing water introduced to the drain chamber 140 rises along a third drain 511 which makes the drain chamber 140 and the soil chamber 515 in the lower piece 510, and, therefrom, is introduced to the soil chamber 515. In this instance, heavy soil in the washing water introduced to the drain chamber 140 deposits on a bottom of the drain chamber 140 by gravity, while only light soil and washing water is introduced to the soil chamber 515. Thus, the drain chamber 140 serves to deposit soil, resulting to filter the washing water.

Referring to FIG. 2, the soil chamber 515 is formed at the lower piece 510 to surround the impeller housing of the water supply pump 300. The soil chamber 515 receives and holds the washing water pumped by the water supply pump 300, and passed through the drain chamber 140. If the washing water keeps flowing into the soil chamber 515, a water level of the soil chamber 515 rises, until the washing water overflows from the soil chamber 515, finally.

In the meantime, the cover 600 covers the water guide assembly 500 and the sump housing 100. The cover 600 is, for an example, circular, and, as shown in FIG. 2, has a plurality of openings at a center portion, to each of which a mesh form of filter 610 is provided. The openings and the filters 610 are over the soil chamber 515. Accordingly, the washing water overflowed from the soil chamber 515 passes through, and filtered at the filters 610, and dirt which does not pass through the filter deposits in the soil chamber 515.

The cover 600 has a plurality of apertures 620 in a periphery. The apertures guide the washing water washed the dishes in the tub 20 of the dishwasher, and fallen downward, and the washing water overflowed from the soil chamber 515, and passed through the filters 610 to the sump housing 100. The washing water guided to the sump housing 100 is held in the recess 110 at the center of the sump housing 100, together.

Referring to FIG. 2, on the upper surface of the cover 600, there are a first nipple 640 at a center of the cover 600, and a second nipple 630 at an edge of the cover 600. The first nipple 640 is in communication with the first guide flow passage 500 of the water guide assembly 500, and the second nipple 630 is in communication with the second guide flow passage 555 of the water guide assembly 500. The first nipple 640 is connected to the second connection pipe 65 connected to the lower arm 45, and the second nipple 630 is connected to the first connection pipe 61 connected to the upper arm 41. According to this, the washing water introduced to the first guide flow passage 557 is supplied to the lower arm 45 through the first nipple 640 and the second connection pipe 65, and the washing water introduced to the second guide flow passage 555 is supplied to the lower arm 45 through the second nipple 630, and the first connection pipe 61.

In the meantime, the dishwasher of the present invention can remove sticky food from the dishes completely by using hot washing water. For this, in the sump housing 100, there is a heater assembly 200 for heating the washing water in the recess 110. The heater assembly 200 is mounted to the recess 110 such that the heater assembly 200 can be mounted/dismounted on/off the sump housing 100 from an outside of the sump housing 100. The heater assembly 200 will be described in detail with reference to FIGS. 2 to 5.

Figure 3:
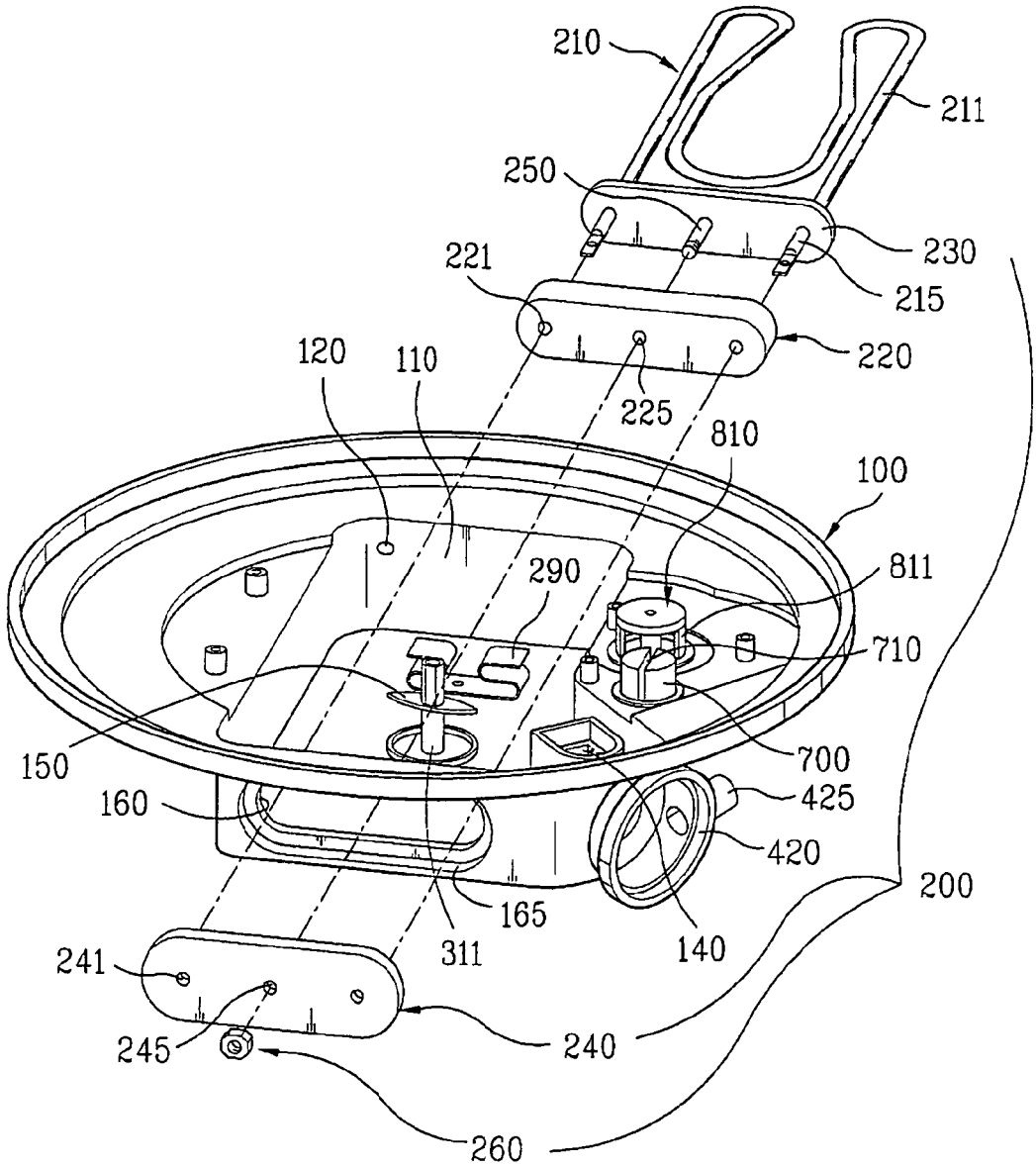
FIG. 3 illustrates an exploded perspective view showing a heater being mounted to a sump housing in the sump assembly in FIG. 2.

The heater assembly 200 is mounted on a bottom of the sump housing 100, for an example, a bottom of the recess 110. As shown in FIG. 3, in a side of the sump housing 100, there is an opening 160, and the heater assembly 200 is mounted to pass through the opening 160. The heater assembly includes a heater 210 for heating the washing water, and a holding mechanism for detachably fastening the heater 210 to the sump housing 100 from an outside of the sump housing 100.

The heater 210 includes a heat generating portion 211 positioned in the sump assembly 50, more specifically, in the recess 110 for heating the washing water, and a terminal 215 connected to the heat generating portion 211. The heat generating portion 211 is bent many times for covering a large area of the recess 110, and the terminal 215 is passed through the opening 160, and projected to an outside of the sump housing 100.

Even though the heat generating portion 211 of the heater 210 is bent many times, the heater assembly 200 does not interfere with components in the sump housing 100 when the heater assembly 200 is placed in/taken out of the sump housing 100 through the opening 160. That is, as described before, though the shaft 311 of the water supply pump 300 passes through the inside of the sump housing 100, since the heat generating portion 211 is bent to surround the shaft 311 and the disposer 150 in a "U" shape, the heater assembly 200 do not interfere with the shaft 311 and the disposer 150 when the heater assembly 200 is taken out of the sump housing 100.

The heater 210 has one side fastened to the sump housing 100 with the holding mechanism, which will be described in more detail. The opening 160 has a packing 220 placed therein, and the terminal 215 of the heater 210 is mounted to pass through the packing 220 through holes 221. The packing seals the opening 160, for preventing the washing water from leaking through the opening 160. Only with such a basic structure, the heater 210 can be mounted in the sump housing securely, and moreover, can be separated from the sump assembly 50 by pulling the heater assembly 200 from an outside of the sump housing 100.

However, the present invention further provides a pressing mechanism for enhancing a sealing capability of the packing 220, and making the heater 210 to be fastened more securely. By pressing, and deforming the packing 220 provided to the opening 160, the pressing mechanism prevents the washing water from leaking through the opening, perfectly. In addition to this, the pressing mechanism prevents the packing 220 from falling off the opening 160 when the heater assembly 200 is mounted to the sump housing 100, fully.

The pressing mechanism includes a first member 230 and a second member 240 arranged opposite to each other with the packing 220 in between, and third members connected to the first member 230 and the second member 240 respectively for varying a distance therebetween as the third members fastened, or loosened, to press or release the pressing to the packing 220.

The first member 230 is positioned in the sump housing 100, connected to the heater 210, and in contact with one surface of the packing 220. The first member 230 has a size identical to or smaller than the opening 160, substantially. The packing 220 also has a size which can be inserted in the opening 160. Therefore, an assembly of the heater 210, the first member 230, and the packing 220 can be inserted into the recess 110 of the sump housing 100 through the opening 160 from an outside of the sump housing 100.

The second member 240 is positioned on an outside of the sump housing 100, has an edge held at an outside surface of the sump housing 100, and is in contact with the other surface of the packing 220. The second member 240 has a size greater than the opening 160, and covers the opening 160. Accordingly, when the heater assembly 200 is mounted to the sump housing 100 fully, the second member 240 prevents the heater assembly 200 from moving into the sump housing 100 through the opening 160.

Figure 4:
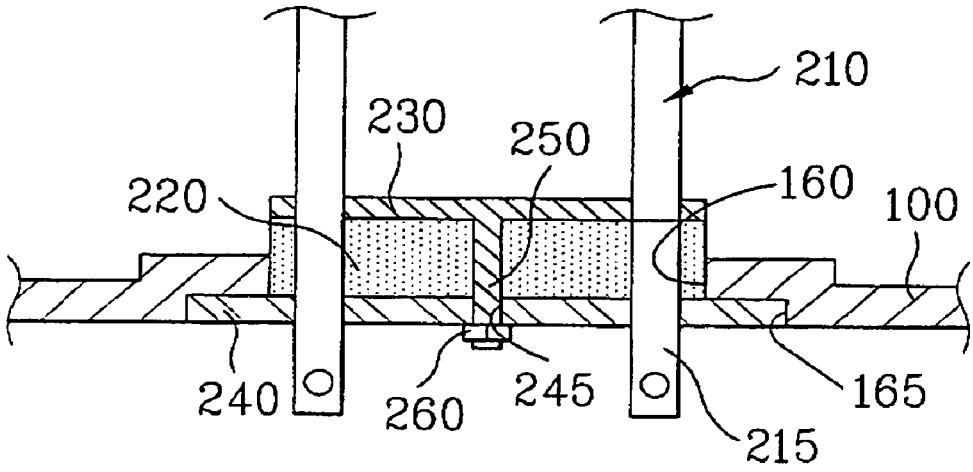
FIG. 4 illustrates a partial section showing a holding mechanism before a pressing mechanism presses a packing in the heater assembly in FIG. 3.
Figure 5:
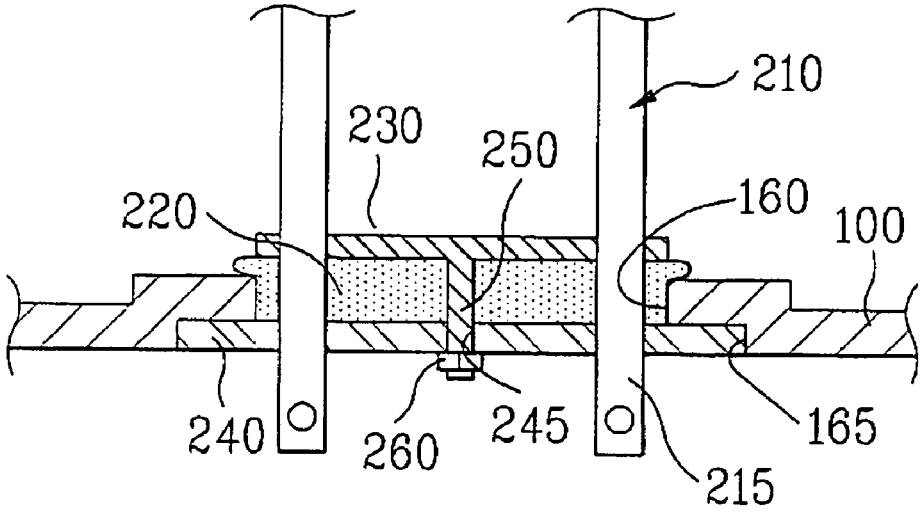
FIG. 5 illustrates a partial section showing a holding mechanism after a pressing mechanism presses a packing in the heater assembly in FIG. 3.

Referring to FIGS. 4 and 5, in an outside surface of the sump housing 100, there is a recessed seat 165 for receiving the edge of the second member 240. Therefore, when the heater assembly 200 is mounted to the sump housing 100, a surface of the second member 240 is not projected beyond the outside surface of the sump housing 100.

The third member can be fastened, or released from the outside of the sump housing 100, and includes, for an example, a bolt 250, and a nut 260. The bolt 250 is extended from the first member 230, passes through the packing 220 and the second member 240 through the hole 225 in the packing 220, and the hole 245 in the second member 240 respectively, and projected to the outside of the sump housing 100. The nut 260 is fastened to the bolt 250 from the outside of the sump housing 100. Therefore, when the nut 260 is fastening from the outside of the sump housing 100, the first member 230 is coming closer to the second member 240, to press the packing 220. Opposite to this, when the nut 260 is releasing from the outside of the sump housing 100, the first member 230 is moving away from the second member 240, to release the packing 220.

Referring to FIG. 4, in order to mount the heater assembly 200, an assembly of the heater 210, and the first member 230 is placed in the sump housing 100 through the opening 160. Then, the packing 220 is placed in the opening 160. Then, the terminal 215 of the heater 210, and the bolt 250 of the third member pass through the packing 220, and exposed to an outside of the sump housing 100. Once the packing 220 is placed in the opening 160, the nut 260 is fastened to the bolt 250 as shown in FIG. 4.

Referring to FIG. 4, the heater assembly 200 is not fastened to the sump housing 100 fully unless the pressing mechanism presses the packing 220. That is, since the packing 220 and the first member 230 have sizes identical or smaller than the opening 160 substantially, if the heater assembly 200 is pulled to an outside of the sump housing 100, the heater assembly 200 is separated from the sump assembly 50.

However, referring to FIG. 5, if the nut 260 is fastened, the packing 220 is pressed by the first member 230 and the second member 240, to expand a side of the packing 220 accordingly. Because the packing has a thickness greater than a depth of the opening 160, a side portion of the packing 220 not in contact with an inside surface of the opening 160 expands in a lateral direction as shown in FIG. 5. The portion of the packing 220 pressed by the pressing mechanism and expanded in the lateral direction thus is held at an inside surface of the sump housing 100, thereby preventing the heater assembly 200 from moving to the outside of the sump housing 100 through the opening 160.

As described, once the third member is fastened, the heater assembly 200 is fastened to the sump housing 100 securely, and once the third member is released, the heater assembly 200 can be separated from the sump housing 100 easily from the outside of the sump housing 100. Therefore, when the heater assembly 200 is out of order, or replacement of the heater 210 is required, an easy replacement of the heater assembly 200 can be made without disassembling the sump assembly 50.

Figure 6:
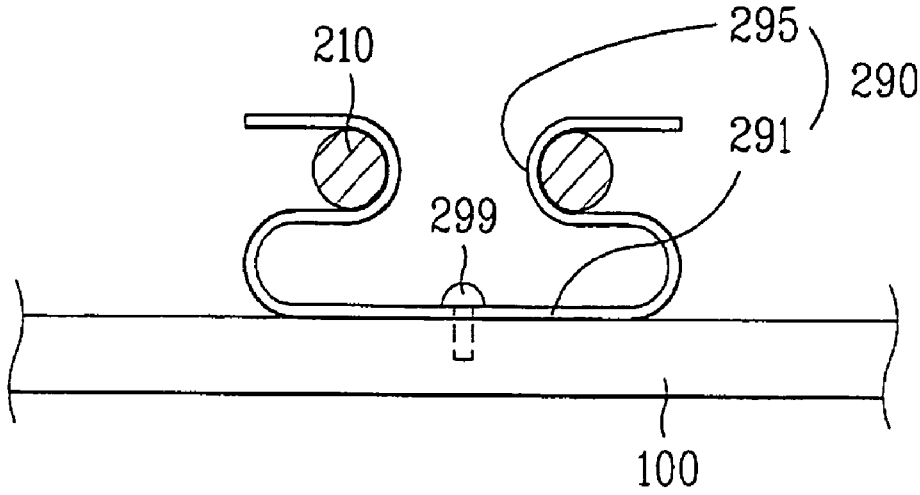
FIG. 6 illustrates a section showing one end of a heater clamped to a sump housing with a clamp.

In the meantime, as shown in FIGS. 3 and 6, while the one end of the heater 210 is fastened to the sump housing 100 by the pressing mechanism, the other end of the heater 210 is clamped with a clamp 290 on a bottom of the sump housing 100. The clamp 290 is secured to the bottom of the recess 110, for holding the heat generating portion 211 to prevent the heat generating portion 211 from shaking by the circulation of the washing water.

The clamp 290 has one or more than one curved portion 295 for tight holding the heat generating portion 211 of the heater 210. In more detail, the curved portion 295 includes opposite one pair connected with a connection portion 291. As shown in FIG. 6, the connection portion 291 is fastened to the recess 110 with a fastening member, such as a screw 299.

The one pair of curved portions 295 holds the heat generating portion 211. When the heater assembly 200 is inserted into the sump housing 100 through the opening 160, the heat generating portion 211 slides into the curved portions 295 of the clamp 290. Opposite to this, if the heater assembly 200 is drawn out of the sump housing 100 through the opening 160, the heat generating portion slides away from the curved portions 295. Thus, though the clamp 290 holds the other end of the heater 210, the clamp 290 does not impede movement of the heater 210 when the heater assembly 200 is mounted/dismounted to/from the sump housing 100. According to this, the heater assembly 200 can be mounted/dismounted to/from the sump housing 100 from the outside of the sump housing 100.

The operation of the sump assembly 50 of the present invention will be described. When the dishwasher starts a process of washing or rinsing the dishes, clean washing water is supplied to the recess 110 of the sump housing 100 through the water supply hole 120 connected to the water supply pipe 70, where the washing water is heated by the heater 210. Upon completion of water supply, the motor 310 of the water supply pump 300 is operated, to pump up the washing water from the recess 110 by the impeller 320.

A portion of the washing water pumped thus is introduced to the valve receiving portion 553 through the outlet 551, and therefrom is guided to the first guide flow passage 557, or the second guide flow passage 555 by the diverting valve 810. The washing water guided to the first guide flow passage 557 is supplied to the lower arm 45, and the washing water guided to the second guide flow passage 555 is supplied to the upper arm 41. The washing water supplied to the lower arm 45 washes dishes on the lower rack 35, and the washing water supplied to the upper arm 41 washes dishes on the upper rack 31.

The washing water washed the dishes in the tub 20, and soil from the dishes falls down. Then, the soil and the washing water is introduced to an inside of the sump housing 100 through the apertures 620 in the periphery of the cover 600 again, and held in the recess 110, again. As described before, the washing water returned to the recess 110 contains much dirt. The dirt is smashed by the disposer 150 between the impeller 320 and the bottom of the recess 110 of the sump housing 100. The dirt smashed thus is pumped by the pump together with the washing water.

In the meantime, rest of the washing water pumped by the impeller 320 is introduced to the bypass 556. The washing water introduced to the bypass 556 passes through the channel 710 of the sensor assembly 700, and, as described before, the degree of contamination of the washing water passing through the channel 710 is sensed accurately by the sensor assembly 700. According to this, time periods and times of washing and rinsing and the like can be adjusted with reference to the degree of contamination of the washing water sensed by the sensor assembly 700.

The washing water passed through the channel 710 of the sensor assembly 700 is introduced to the drain chamber 140 through the first drain 554 and the second drain 513. In this instance, since the drain pump 400 is not operated, the washing water is not discharged to the outside of the dishwasher, but is introduced to the soil chamber 515 through the third drain 511. In this instance, large particles of the soil contained in the washing water introduced to the drain chamber 140 deposit in the drain chamber 140, to introduce only light particles of soil to the soil chamber 515 after rising along the third drain 511.

The washing water and soil introduced to the soil chamber 515 is held in the soil chamber 515. As time passes by, a water level of the soil chamber 515 rises, until the washing water overflows the soil chamber 515. The washing water overflowed thus passes through the filter 610, and is introduced to the sump housing 100 through the apertures 620 in the sump housing 100. However, the soil introduced to the soil chamber 515 can not pass through the filter 610, the soil remains and is accumulated in the soil chamber 515.

As described before, a portion of the pumped washing water passes the bypass 556, cleaned by the soil chamber 515 and the filter 610, and supplied to the sump housing 100. again. Though it appears that the soil chamber 515 and the filter 610 filter a small amount of washing water, the soil chamber 515 and the filter 610 have a good washing capability because the soil chamber 515 and the filter 610 filter the washing water throughout the washing or rinsing process.

In the meantime, if the washing or rinsing process is finished, or the washing water is contaminated heavily, the drain pump 400 is operated. Then, the washing water, and the soil is discharged from the soil chamber 515, the drain chamber 140, and the recess 110 of the sump housing 100 to the outside of the dishwasher through the drain hose 80 by the drain pump 400.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The spray of the hot washing water to the dishes permits to remove sticky food from the dishes completely.

The heater assembly mounted to the sump housing by means of special holding mechanism and the pressing mechanism permits easy mounting/dismounting of the heater assembly to/from the sump assembly from an outside of the sump assembly, and perfect prevention of water leakage from a connection portion between the sump housing and the heater assembly.

The invention claimed is:

1. A dishwasher comprising:

a sump housing to hold washing water having an opening in a side;

a heater assembly fastened to an inside of the sump housing to heat the washing water; and a pump to pump washing water heated by the heater assembly, the pump comprising an impeller mounted above the heater assembly for pumping the washing water, a motor mounted to an outside of the sump housing and a shaft for transmission of driving force from the motor to the impeller, wherein the heater assembly can be attached or detached to the sump housing by passing through the opening, which is positioned between a bottom of the sump housing and the impeller.

2. The dishwasher as claimed in claim 1, further comprising:

a water guide assembly mounted on an upper side of the sump housing having a space to mount an impeller and having a supply channel to supply washing water to at least one spray arm;

wherein the impeller is mounted on the space of the water guide to pump washing water stored in the sump housing to the supply channel, and the shaft connects the impeller with the motor to pass through a bottom of the water guide and the bottom of the sump housing.

3. The dishwasher as claimed in claim 2, further comprising a disposer rotatably mounted in the sump housing between the impeller and the bottom of the sump housing for smashing soil contained in the washing water.

4. The dishwasher as claimed in claim 3, wherein the impeller and the disposer are driven by the same motor.

5. The dishwasher as claimed in claim 3, wherein the heater assembly is designed not to interfere with the disposer when the heater assembly is separated from the sump housing.

6. The dishwasher as claimed in claim 5, wherein the heater assembly includes; a heater passed through the opening for heating the washing water, and a packing inserted in the opening for sealing the opening, and the heater passing therethrough.

7. The dishwasher as claimed in claim 6, wherein the heater assembly further includes a clamp fastened to the sump housing for holding the heater.

8. The dishwasher as claimed in claim 6, wherein the heater assembly includes a pressing mechanism for pressing down to deform the packing, to seal the opening completely.

9. The dishwasher as claimed in claim 1, wherein the heater assembly is provided to a bottom of the sump housing.

10. The dishwasher as claimed in claim 1, wherein the heater assembly is designed not to interfere with components in the sump housing when the heater assembly is inserted into the sump housing or drawn out of the sump housing through the opening.

11. A dishwasher comprising:

a tub for placing dishes therein;

a sump housing to hold washing water having an opening in a side;

a heater assembly fastened to an inside of the sump housing to heat the washing water;

a pump to pump washing water heated by the heater assembly, the pump comprising an impeller mounted above the heater assembly to pump the washing water, a motor mounted to an outside of the sump housing and a shaft for transmission of driving force from the motor to the impeller; and at least one spray nozzle to spray the washing water supplied from the impeller to the dishes in the tub, wherein the heater assembly can be attached or detached to the sump housing by passing through the opening, which is positioned between a bottom of the sump housing and the impeller.

12. The dishwasher as claimed in claim 11, further comprising:

a water guide assembly, mounted on an upper side of the sump housing, having a space to mount an impeller and having a supply channel to supply washing water to the at least one spray arm;

wherein the impeller is mounted on the space of the water guide to pump washing water stored in the sump housing to the supply channel, and the shaft connects the impeller with the motor to pass through a bottom of the water guide and the bottom of the sump housing.

* * * * *